US007441770B2

(12) United States Patent
Eyraud et al.

(10) Patent No.: US 7,441,770 B2
(45) Date of Patent: Oct. 28, 2008

(54) CONVEYOR APPARATUS HAVING A TWICE-TWISTED BELT AND A FLOATING-TENSION PULLEY

(75) Inventors: Fabrice Eyraud, Portes les Valence (FR); Jean Rieu, Saint-Georges-les-Bains (FR); Raymond Chifflet, Guilherand Granges (FR)

(73) Assignee: Solystic, Gentilly (FR)

( * ) Notice: Subject to any disclaimer, the term of this patent is extended or adjusted under 35 U.S.C. 154(b) by 287 days.

(21) Appl. No.: 11/099,537

(22) Filed: Apr. 6, 2005

(65) Prior Publication Data

US 2005/0225027 A1 Oct. 13, 2005

(30) Foreign Application Priority Data

Apr. 7, 2004 (FR) ..... 04 50703

(51) Int. Cl.
*B65H 43/04* (2006.01)
*B65G 23/44* (2006.01)

(52) U.S. Cl. ..... 271/198; 271/303; 198/813; 198/814; 198/405

(58) Field of Classification Search ..... 271/198, 271/303, 305, 186; 198/812, 813, 814, 588, 198/405, 417, 839, 436, 437
See application file for complete search history.

(56) References Cited

U.S. PATENT DOCUMENTS

| | | | | | |
|---|---|---|---|---|---|
| 5,265,713 | A | * | 11/1993 | Marchadour | 198/524 |
| 5,372,360 | A | * | 12/1994 | Ricciardi | 271/177 |
| 5,535,997 | A | | 7/1996 | Croyle et al. | |
| 5,540,318 | A | * | 7/1996 | Hulse | 198/405 |
| 5,971,161 | A | | 10/1999 | Branecky et al. | |

FOREIGN PATENT DOCUMENTS

| | | | |
|---|---|---|---|
| EP | 1 040 919 | A | 10/2000 |
| FR | 2 555 974 | A | 6/1985 |

* cited by examiner

*Primary Examiner*—Patrick Mackey
*Assistant Examiner*—Luis A Gonzalez
(74) *Attorney, Agent, or Firm*—Sughrue Mion, PLLC

(57) ABSTRACT

A conveyor apparatus including a main conveyor by which mail items are routed by being nipped between a transport belt and a main belt, and a secondary conveyor towards which the mail items are routed, after switching, along a secondary belt. The main and secondary belts performing the main conveying and the secondary conveying functions are constituted by a single, common belt that is twisted twice. The twice-twisted belt is engaged over a tensioner pulley that is a floating pulley.

3 Claims, 2 Drawing Sheets

PRIOR ART
FIG_1
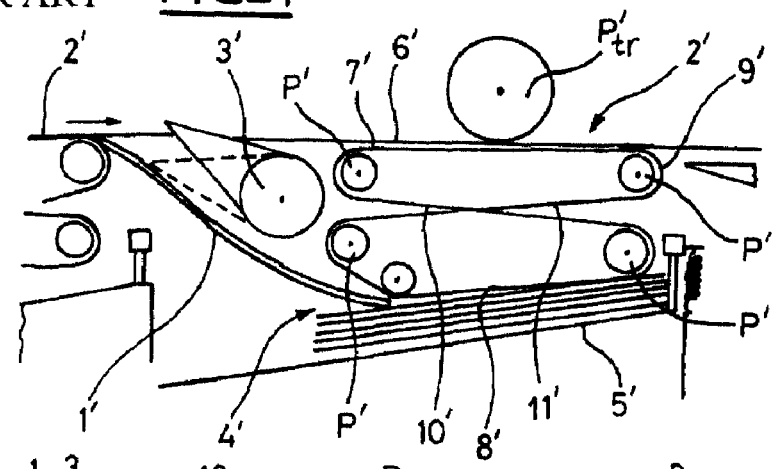
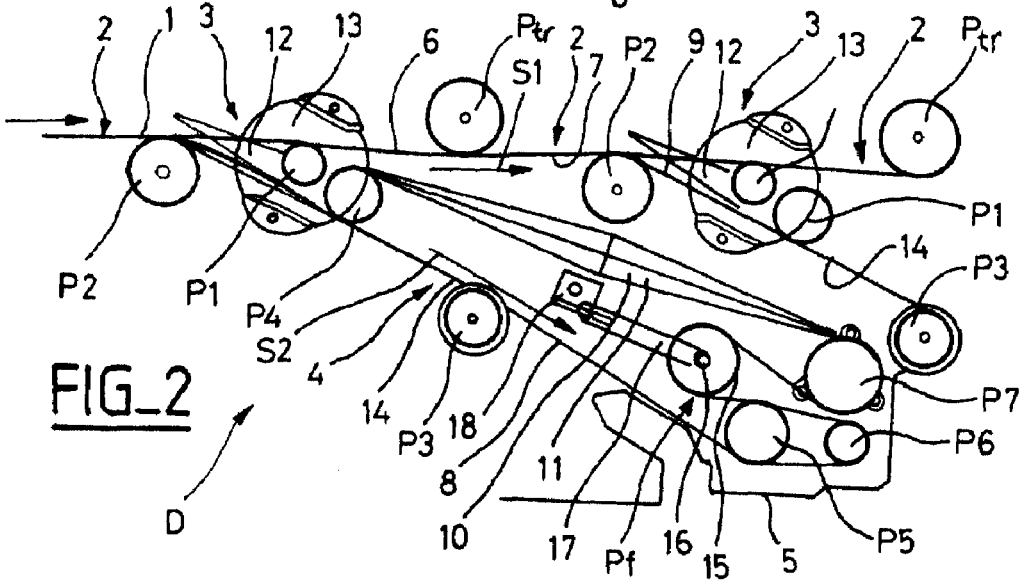
FIG_2
FIG_3
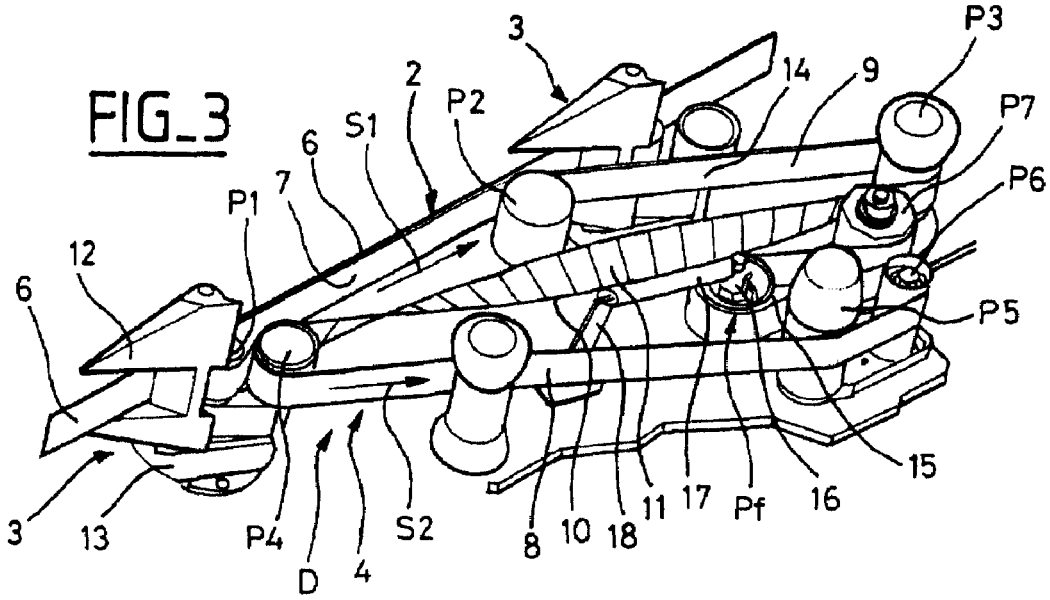

CONVEYOR APPARATUS HAVING A TWICE-TWISTED BELT AND A FLOATING-TENSION PULLEY

BACKGROUND OF THE INVENTION

The invention relates to conveyor apparatus comprising a main conveyor by which mail items are routed by being nipped between a transport belt and a main belt, and a secondary conveyor towards which the mail items are routed, after switching, along a secondary belt, said main and said secondary belts performing the main conveying and the secondary conveying functions being constituted by a single, common belt that is twisted twice.

Such conveyor apparatus is known from Patent Document FR-2 555 974. It is used for switching mail items and stacking them in the sorting outlets of a postal sorting machine. In that known conveyor apparatus which is shown very diagrammatically in FIG. 1, a mail item 1' is transported by a main conveyor 2' and is switched by a switching flap 3' towards a stacker conveyor 4' of a sorting outlet stacker 5' of a postal sorting machine. The main conveyor 2' is constituted by a transport belt 6' and by a main belt 7' that extends between two sorting outlets and that runs along the belt 6'. The mail item is nipped between the two belts 6' and 7' so as to be routed towards a sorting outlet. The transport belt 6' is driven by at least one motor-driven friction pulley $P'_{tr}$. The stacker conveyor 4' is constituted by a stacker belt 8' which extends in the bottom of the stacker 5'. As can be seen in FIG. 1, the main belt 7' and the stacker belt 8' are formed by a single, common endless belt that is twisted twice and that is designated by overall reference 9' in FIG. 1. That twice-twisted belt 9' travels over a generally figure-of-eight shaped path so as to produce two movements for driving the mail items 1', which movements are in the same direction, are substantially parallel, and are of equal speeds. In the example shown in FIG. 1, the belt 9' is engaged over four main pulleys P' that define the figure-of-eight shaped path, and it has rectilinear segments 10', 11' that are substantially superposed, and that cross over at the intersection between the two loops of the figure-of-eight shaped path. The pulleys P' can be idler pulleys, while the single motor-driven pulley drives the transport belt 6' and also the twice-twisted belt 9' which is in friction contact with the belt 6'. That arrangement guarantees, in simple manner, that the two belts 6' and 9' are driven at an identical drive speed.

In such conveyor apparatus, it has been observed that the path of the belt 9' can vary in the vertical plane, which is detrimental to proper operation of the stackers of the sorting machine. Such untimely displacements of the belt 9' are presently eliminated by regularly and manually re-centering the belt 9'on the pulleys P', which gives rise to non-negligible maintenance costs.

SUMMARY OF THE INVENTION

An object of the invention is to mitigate that drawback.

To this end, the invention provides conveyor apparatus comprising a main conveyor by which mail items are routed by being nipped between a transport belt and a main belt, and a secondary conveyor towards which the mail items are routed, after switching, along a secondary belt, said main and said secondary belts performing the main conveying and the secondary conveying functions being constituted by a single, common belt that is twisted twice, said conveyor apparatus being characterized in that said twice-twisted belt is engaged over a tensioner pulley that is a floating pulley.

In a particular embodiment of the conveyor apparatus of the invention, the floating pulley has a rotary shaft whose floating ends are connected to respective ones of two tensioners, e.g. helical springs mounted in respective support tubes for the purposes of controlling belt lengthening.

The floating pulley of the invention thus has an axis of rotation that is mounted to be floating in three-dimensional space. With this arrangement, it is thus simple for the twice-twisted belt to be stabilized simply in the vertical plane by self-centering with, in addition, the twice-twisted belt being tensioned dynamically, which compensates for it lengthening over time.

In the conveyor apparatus of the invention, the twice-twisted belt follows a figure-of-eight shaped path having two loops, and said belt has two twisted belt segments that are superposed where the two loops cross over, said two belt segments being in contact with each other over their entire length between two deflector pulleys. With this arrangement of the twice-twisted belt, friction noise in the conveyor apparatus is reduced considerably.

BRIEF DESCRIPTION OF THE DRAWINGS

The invention will be better understood on reading the following description of an embodiment given with reference to the figures, in which:

FIG. 1 is a diagrammatic view of prior art conveyor apparatus;

FIG. 2 is a diagrammatic view of the conveyor apparatus of the invention;

FIG. 3 is a diagrammatic perspective view of the conveyor apparatus of the invention shown in FIG. 2;

FIGS. 2 and 3 thus show the same embodiment of conveyor apparatus D having a twice-twisted belt and a floating tensioner pulley for a stacker of a postal sorting machine.

DETAILED DESCRIPTION OF THE INVENTION

Figure 4:
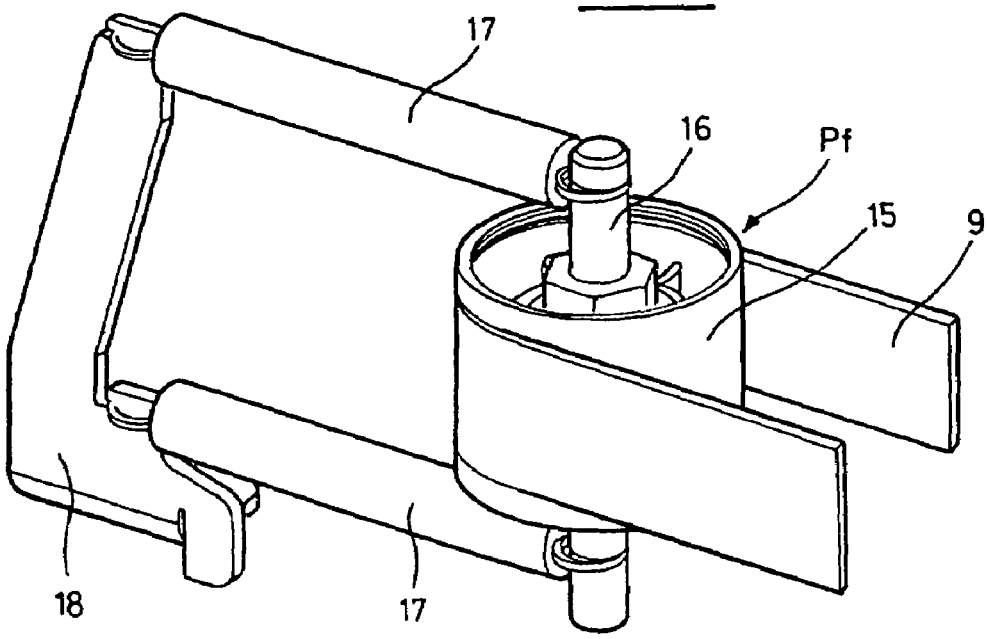
FIG. 4 is a diagrammatic view of a floating pulley of the invention.

As shown in FIG. 2, a mail item 1, in particular a letter or any other flat postal item, moved by a main conveyor 2 of the conveyor apparatus D is switched by a switching flap 3 towards a stacker conveyor 4 in order to be routed towards a stacker 3 at a sorting outlet of a postal sorting machine. The switching flap 3, which can be seen more clearly in FIG. 3, is constituted by a fork-shaped finger 12 mounted to pivot on a soleplate 13 provided with a guide channel for guiding the foot of the mail item.

The main conveyor 2 comprises a transport belt 6 driven by friction by a set of motor-driven pulleys $P_{tr}$ distributed along the sorting outlets of the sorting machine. At each sorting outlet, the belt 6 co-operates by nipping with a first rectilinear segment 7 (forming a main belt) of a twice-twisted belt 9 that is engaged around deflector pulleys P1 and P2 disposed in alignment along the belt 6. As can be seen in FIG. 2, a switching flap 3 is interposed between every two consecutive sorting outlets. The belts 6 and 9 have the same direction of advance along the segment 7.

The stacker conveyor 4 comprises a stacker belt (or secondary belt) constituted by a second segment 8 of the twice-twisted belt 9 that extends between two deflector pulleys P4 and P5 over which the belt 9 is engaged. The stacker conveyor 4 further comprises a guide belt constituted by a segment 14 of another twice-twisted belt 9 of adjacent other conveyor apparatus D, said other belt 9 being engaged around pulleys P2 an P3 disposed in alignment with the segment 8. A mail item 1 passing into the stacker conveyor 4 is nipped between the stacker belt and the guide belt so as to be routed in the direction of advance S2 towards the stacker 5 of the sorting outlet.

A twice-twisted belt 9 in conveyor apparatus D thus performs the functions both of main conveyor 2 and of stacker conveyor 4.

The figure-of-eight shaped path of the twice-twisted belt 9 is defined by disposing a set of deflector pulleys P1, P2, P3, P4, P5, P6 and one motor-driven pulley P7. As can be seen in FIGS. 2 and 4, the figure-of-eight shaped path of the belt 9 forms a first loop defined by the deflector pulleys P1, P2, P3, P4, and a second loop that crosses the first loop and that is defined by the deflector pulleys P4, P5, P6, Pf and by the motor-driven pulley P7.

The twice-twisted belt has two twisted belt segments 10, 11 which are superposed where the two figure-of-eight loops cross over. The two parallel belt segments extend between the two deflector pulleys P4 and P7, and they are in contact (face-against-face) with each other over their entire length between said two deflector pulleys P4 and P7. With this arrangement, the operating noise in the conveyor apparatus is reduced considerably because there is no friction between the belt segments 9. More particularly, the path of the twice-twisted belt 9 is as follows: after going round the pulley P3, it rests against the pulley P7 from which it is twisted once until it comes into contact with the pulley P4. After going round the pulley Pf, it rests against the pulley P7 again, and it is twisted again until it comes to rest against the pulley P4, from which it resumes a non-twisted configuration. The belt 9 is thus twisted a first time between the pulleys P7 and P4, and then a second time again between the pulleys P7 and P4, which corresponds to where the two loops of the figure-of-eight formed by the belt 9 cross over.

Even more precisely, it is considered that the belt 9 has a drive face in contact with the pulleys and a friction face in contact with the mail items. The drive face is the inside face of the belt, i.e. the face situated inside the path of the belt. The friction face is the outside face of the belt, i.e. the face situated outside the path of the belt. As can be seen in FIGS. 2 and 3, the two twisted segments 10, 11 of the belt 9 are in contact with each other via the friction faces of the belts.

FIGS. 2 and 3 show the tensioner pulley Pf of the twice-twisted belt 9 which is a floating pulley over which the belt 9 is engaged.

FIG. 4 shows the pulley Pf, which is normally an idler pulley, in more detail. It comprises a wheel 15 that is mounted to rotate freely on a shaft 16 whose ends are mounted to be floating in three-dimensional space. Pulley Pf is held floating by the action of substantially opposing forces exerted firstly by the belt 9 on the wheel 15 and secondly by two tensioners 17 which are fixed to respective ends of the shaft 16 on either side of the wheel 15. In this example, the two tensioners 17 are helical springs, each of which is mounted in a support tube, and fastened like two tines of a fork to a base 18. The pulley Pf together with the tensioners 17 constitute a dynamic belt tensioner system suitable for compensating for the belt 9 lengthening over time.

Figure 5:
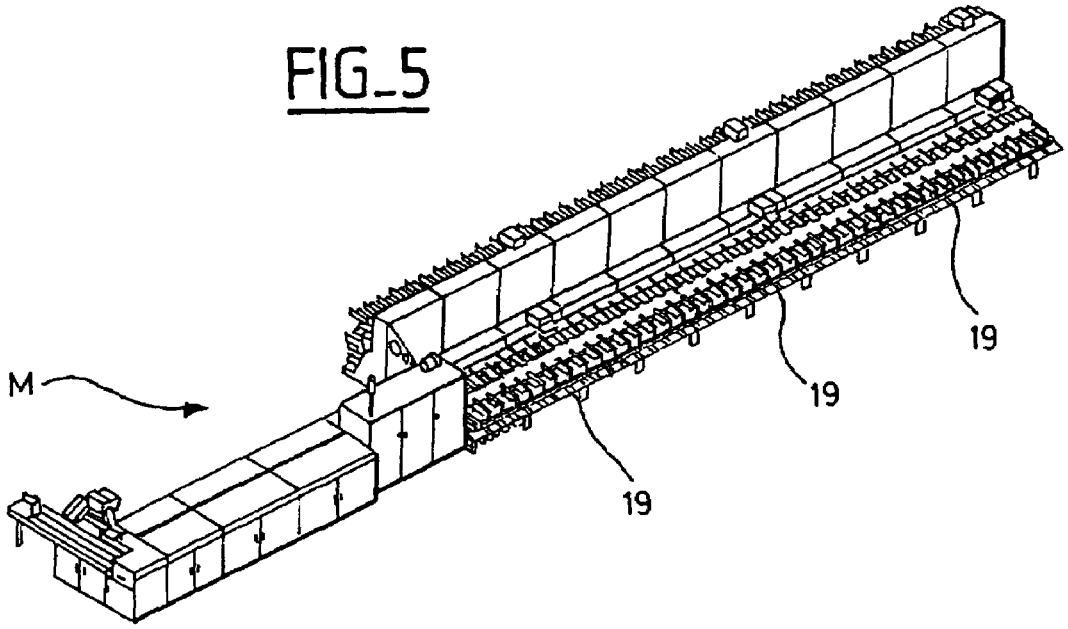
FIG. 5 is a diagrammatic view of a postal sorting machine in which conveyor apparatus of the invention can be used.

FIG. 5 shows a postal sorting machine M having a plurality of sorting outlets 19 with stackers 5, each of which can advantageously be equipped with conveyor apparatus D of the invention.

The invention claimed is:

1. A conveyor apparatus (D) comprising a main conveyor (2) by which mail items are routed by being nipped between a transport belt (6) and a main belt (7), and a secondary conveyor (4) towards which the mail items are routed, after switching, along a secondary belt (8), said main and said secondary belts performing the main conveying and the secondary conveying functions being constituted by a single, common belt (9) that is twisted twice, wherein said twice-twisted belt (9) is engaged over a floating pulley (Pf) which has a rotary shaft (16) whose floating ends are connected to respective ones of two tensioner ends, other tensioner ends being connected to a base (18), and wherein said twice-twisted belt (9) is arranged between said base and said floating pulley (Pf), and wherein the tensioners are helical springs, each of which is mounted in a respective support tube.

2. A conveyor apparatus according to claim 1, in which the twice-twisted belt follows a figure-of-eight shaped path having two loops, and said belt has two twisted belt segments (10, 11) that are superposed where the two loops cross over, said two belt segments being in contact with each other over their entire length between two deflector pulleys (P4, P7).

3. A postal sorting machine (M) for sorting mail items (1), said machine having a plurality of sorting outlets (19) with a stacker (5) at each sorting outlet, wherein, at each sorting outlet, it includes conveyor apparatus (D) according to claim 1.

* * * * *